US005449326A

United States Patent [19]

File

[11] Patent Number: 5,449,326

[45] Date of Patent: Sep. 12, 1995

[54] BUMPER BOWLING SYSTEM WITH CONTACT SWITCH

[76] Inventor: Jon P. File, P.O. Box 1824, Kamuela, Hi. 96743

[21] Appl. No.: 922,721

[22] Filed: Jul. 31, 1992

[51] Int. Cl.[6] ..... A63D 5/00

[52] U.S. Cl. ..... 473/55; 473/113; 473/115

[58] Field of Search ..... 273/51, 54 R, 54 D; 73/1 D, 1 DV, 11; 473/31, 32, 55, 113, 115; 293/107, 108

[56] References Cited

U.S. PATENT DOCUMENTS 569,519 10/1896 Rodd ..... 473/32

1,213,950 1/1917 Ringsmith ..... 473/32

4,133,042 1/1979 Wallace ..... 473/71

*Primary Examiner*—V. Millin

*Assistant Examiner*—William M. Pierce

*Attorney, Agent, or Firm*—Kenyon & Kenyon

[57] ABSTRACT

A bowling lane is provided with a pair of bumpers to which are attached sensors or switches that are activated when a bowling ball strikes a bumper. The bumpers are attached to brackets that are mounted to the floor. Indicators are mounted on the bumper-bracket assembly for signaling when a given bumper has been hit; the score awarded in a given frame may be made to vary in dependance upon whether a given bumper has been struck.

19 Claims, 6 Drawing Sheets

BUMPER BOWLING SYSTEM WITH CONTACT SWITCH

BACKGROUND OF THE INVENTION

The present invention relates generally to a bowling alley, and more particularly, to a system of bumpers that allows for a greater number of variants of the standard game of bowling to be played.

Bowling is an ancient game. Archaeologists have traced its development through various forms by reference to artifacts dating date back many thousands of years. In recent times, the game's evolution has achieved a standardized form, in which a ball weighing generally between 10 and 16 pounds is rolled down an alley or lane of standardized size towards a set of ten pins arrayed in a fixed configuration. Straddling each side of the bowling lane is a channel-like gutter. In conventional "regulation" bowling, points are scored by knocking down pins; when a ball rolls into the gutter, it becomes a so-called "gutter ball," and no points are earned.

Because of the physical strength necessary to play standard bowling, those with physical impairments or who are otherwise lacking in coordination or strength (e.g., due to handicap or age) may experience the frustration of playing an entire game of ten frames without having knocked down a single pin. This can be especially frustrating to children, who may not have the strength and coordination necessary to play the game.

In response to this problem, numerous systems of "bumper" bowling have been developed. These generally involve placing some sort of bumper or other occluding member in the gutters so that each ball bowled inevitably results in at least some pins being knocked down.

In some systems, bumpers are permanently affixed to the gutters, thereby preventing anyone from playing a game of regulation bowling on the lane. Other systems allow for the removal of "temporary" bumpers from the gutters, through what is generally a laborious process. Another example of a bumper system is provided by U.S. Pat. No. 3,401,933 to Conklin et al. (the contents of which are hereby incorporated by reference). In this device, a pivoting concave cylindrical section is provided along a length of gutter. When in the retracted position, the cylindrical section acts as a standard gutter, enabling the lane to accommodate standard bowling. The patent teaches a complex set of linkages and actuators for raising the curved cylindrical section to a height and orientation at which its raised edge will prevent a ball from leaving the lane prior to striking any pins. This edge is provided with a switch for detecting when a ball has made contact with the raised section. The structure shown is complex and expensive to build and maintain, and does not appear to have won widespread acceptance. Furthermore, this device does not appear to be able to flexibly accommodate other variants of the game of bowling.

There remains a need for a system of bumpers that is inexpensive to make, simple to install and maintain, and which has greater flexibility in the range of games that may be played than has been the case.

SUMMARY OF THE INVENTION

This need is met by the present invention, which discloses a simple bumper system that requires less space per lane than the standard two gutters and lane, and which is versatile to accommodate both standard bowling, bumper bowling, as well as other novel variants of the game.

The bumper system is based on a series of resilient bumpers that are affixed to mounting brackets. The mounting brackets are, in turn, configured to have a fixed, stationary orientation with respect to the bowling lane. In one embodiment, a pneumatic tube to which is attached a pressure activated switch is attached to the bumper. In other embodiments, a strip-like contact switch is affixed to a bumper, or a motion sensor is employed. In all embodiments, contact between the bumper and a bowling ball results in the closure of a switch or the generation of a signal that provides information to a central switching or microprocessor unit. The switch or microprocessor may be used to trigger a light or other indicator (e.g., a buzzer, bell, or video display) when such contact has been made.

DETAILED DESCRIPTION OF THE INVENTION

Figure 1A:
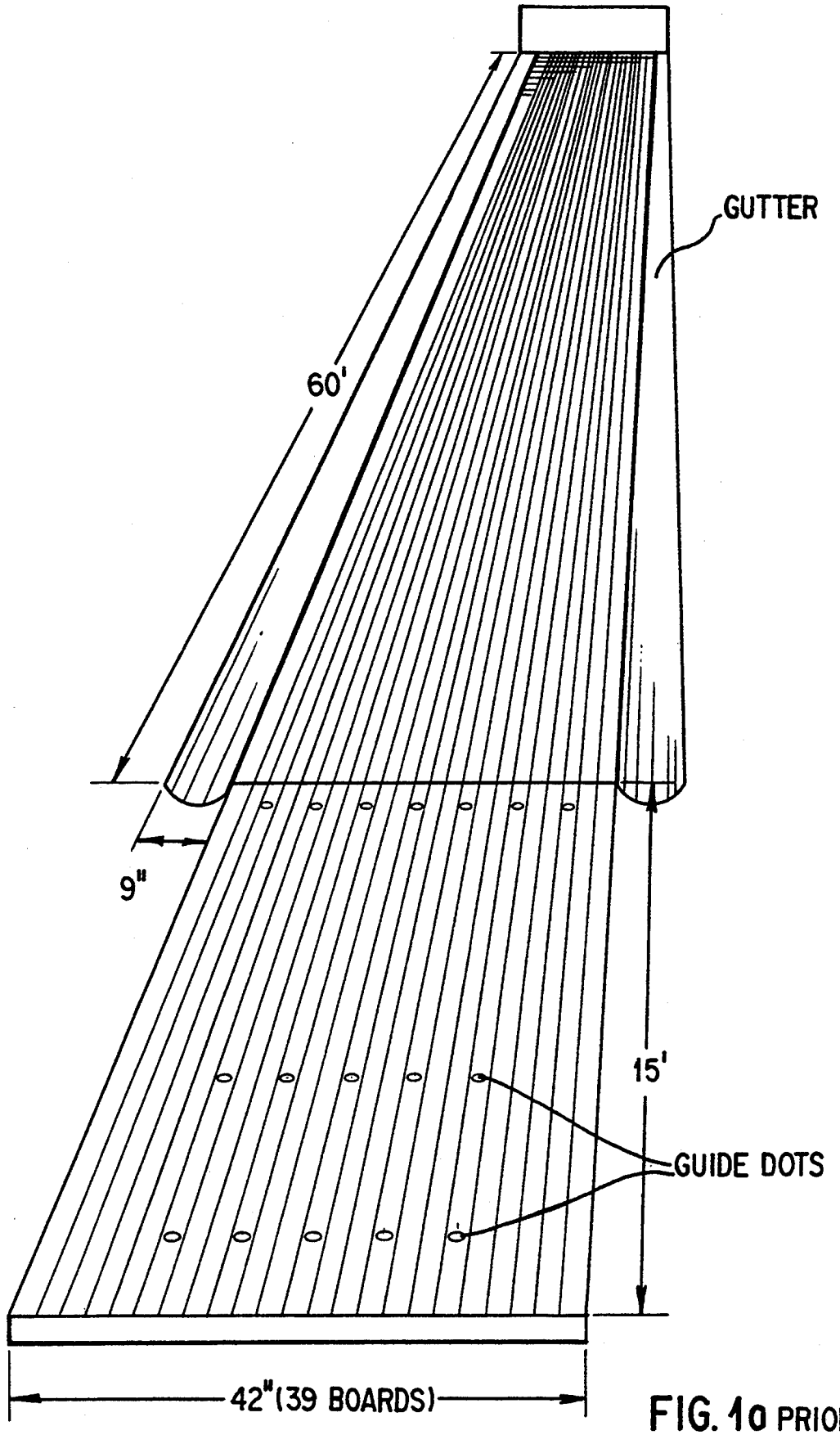
FIG. 1a PRIOR ART
FIG. 1*a* is a front perspective view of a conventional bowling lane.
Figure 1B:
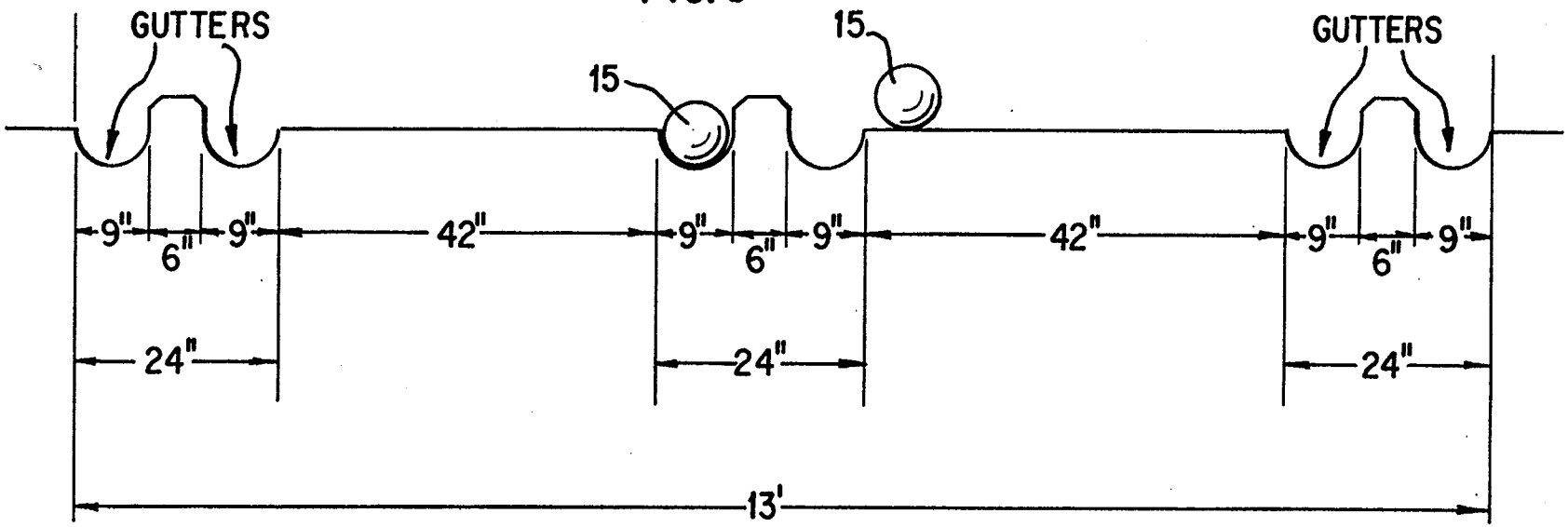
FIG. 1b PRIOR ART
FIG. 1*b* provides a view of the bowling lane shown in FIG. 1*a* in cross-section.

FIGS. 1*a* and 1*b* illustrate the parts and dimensions of a conventional bowling lane. A standard lane is generally 42 inches in width, and is bordered on either side by a gutter 9 inches wide, bringing the overall width of the lane and gutter to 60 inches. Where, as is the case in virtually all commercial bowling alleys, a number of lanes are configured to be situated adjacent to one another, still more space (usually 6–9 inches) must be allotted for properly spacing the lanes apart from each other.

Figure 6:
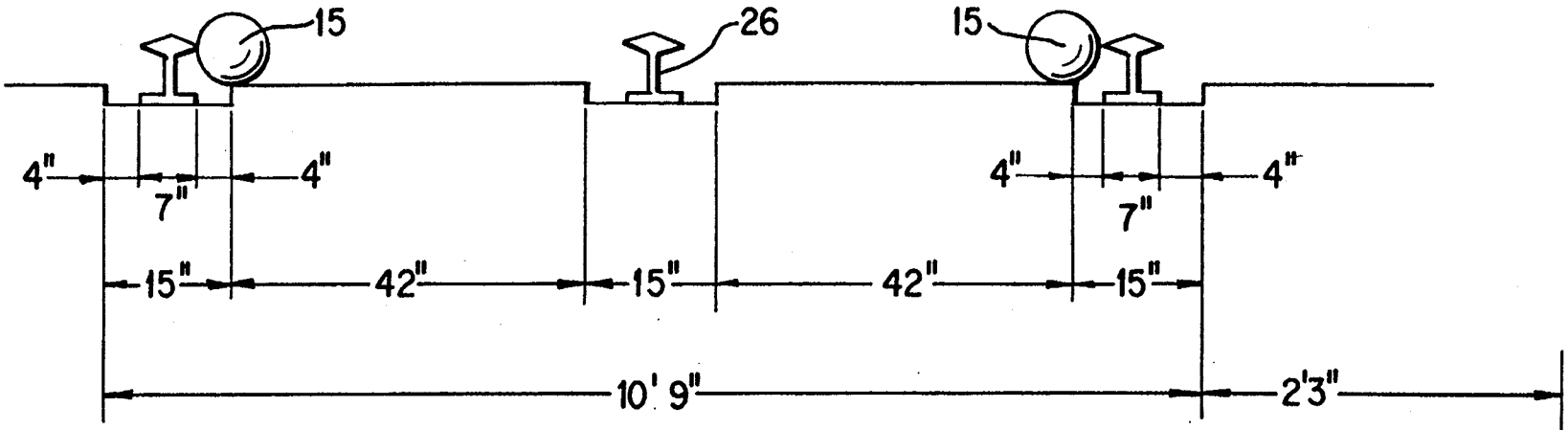
FIG. 6 provides a cross-sectional view of adjacent bowling lanes built according to the present invention.
Figure 2:
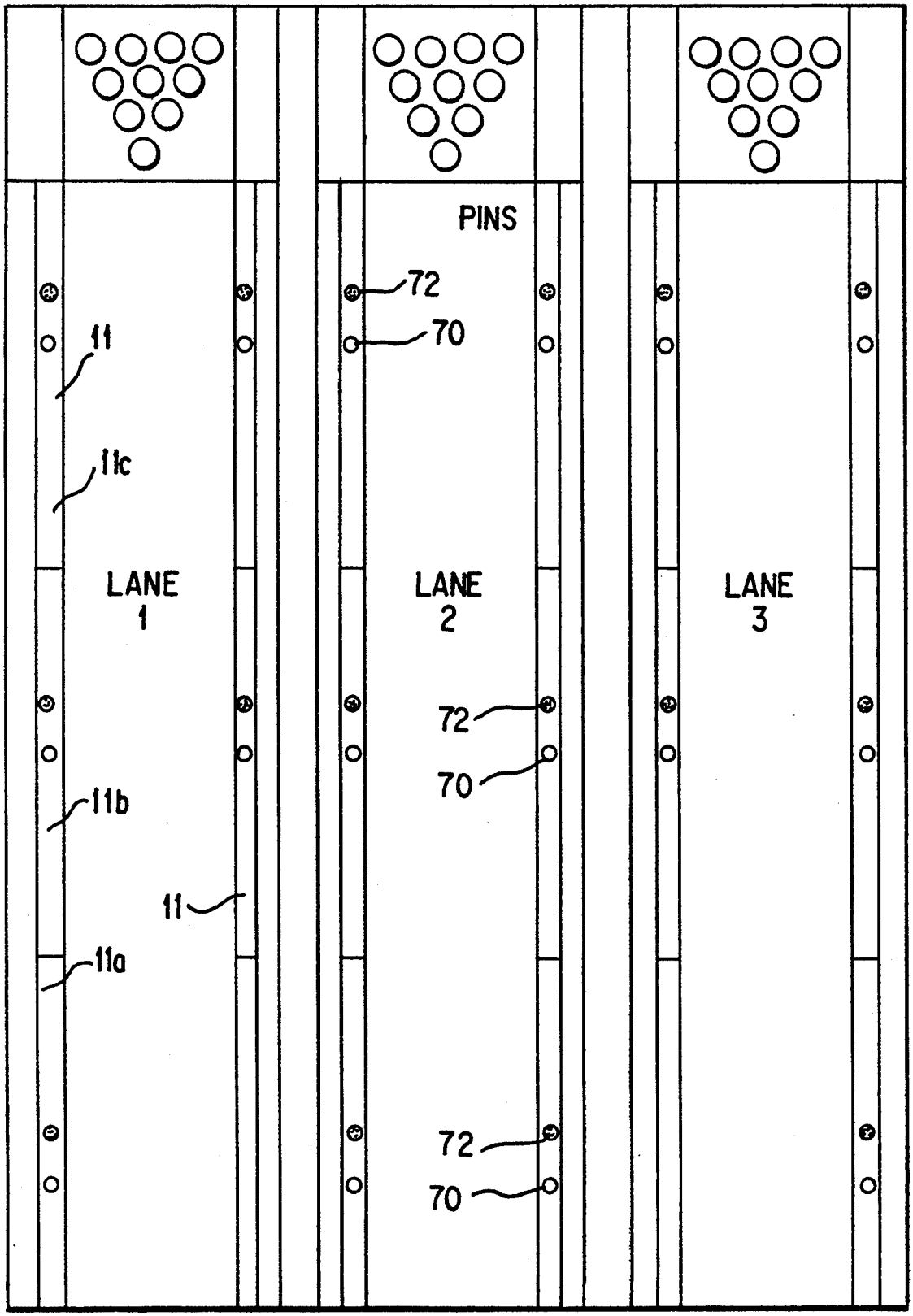
FIG. 2 is a plan schematic view of a bowling alley constructed according to the principles of the invention.
Figure 3:
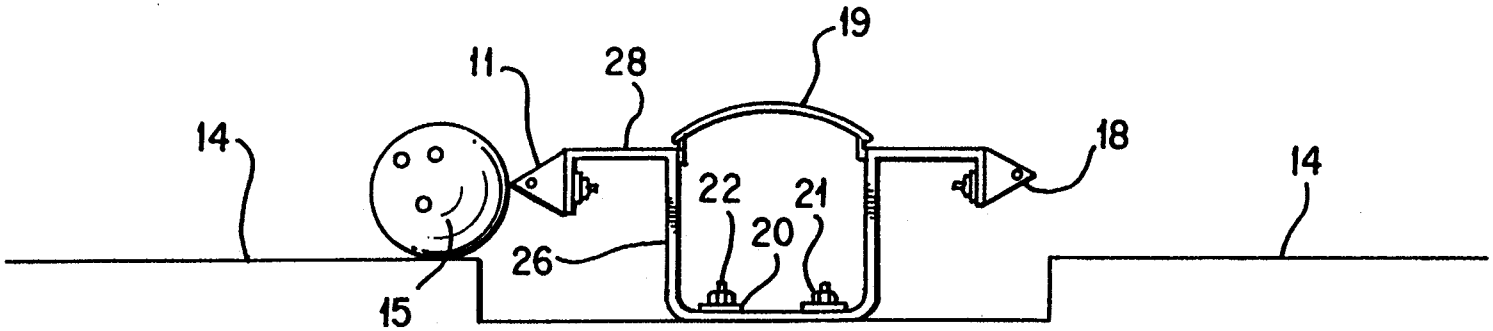
FIG. 3 is a cross-sectional view of a bumper system in which pneumatic tubes are employed.
Figure 4:
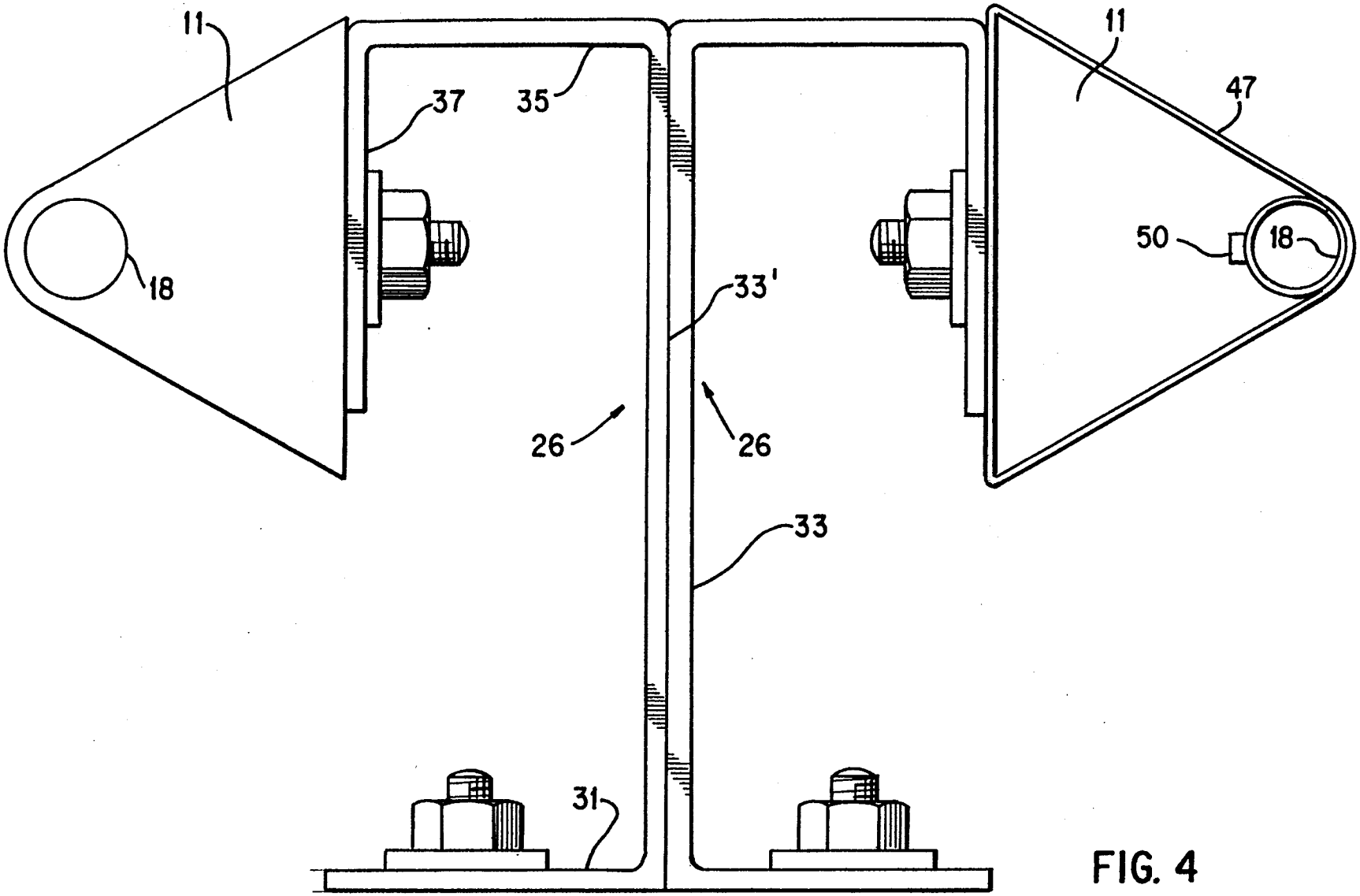
FIG. 4 is a cross-sectional view of a bumper system similar to that shown in FIG. 3.

FIG. 2 shows the overall configuration of a bowling alley constructed according to the principles of the invention. Adjoining each lane is a set of bracket-mounted bumpers. In this figure, the original gutters have been retro-fitted with bumpers built according to the embodiment shown in FIG. 5. Alternately, a bowling alley can be constructed to take advantage of the space-saving features present in other embodiments by using a bumper configuration such as is shown in FIGS. 3, 4, and 6, which require significantly less space per lane than the standard configuration shown in FIG. 1*b*. Whichever embodiment is used, the bumpers running alongside each lane may be subdivided lengthwise into several serially arranged bumpers, each with its own means for detecting contact with a bowling ball.

The bumper system may take a variety of forms, but in each case it is made of a number of bumpers 11 having sufficient strength so as to be able to withstand repeated collisions with the heaviest of bowling balls. These bumpers 11 are rigidly attached to bumper brackets 26, which in turn are bolted to the underlying surface. As seen in FIG. 3, the bracket may consist of a single extrusion having a U-shape in cross section terminating in a pair of laterally extending portions 28 to which are attached the bumpers 11. The center channel of the bracket is covered with a cover 19. Alternatively, the bracket may take the form of an open rectangular extrusion (FIG. 4) having a lower portion 31 for mounting to the floor or lane bed, an upstanding portion 33 for elevating the structure an appropriate height, a transverse portion 35, and a depending portion 37 to which the bumpers are attached. The brackets are configured so that they may abut one another along their surfaces 33', thereby requiring a reduced amount of space.

Two embodiments of the bumper are shown in the left and right hand halves of FIG. 4. In the left hand embodiment, an air tube 18 is molded into the rubber bumper. (This tube may alternatively be filled with a liquid.) In the embodiment shown in the right hand half of the figure, this air tube is positioned externally to the bumper, to which it may be attached with adhesive. The bumper and air tube may be covered with a layer of felt 47 so that the tube is not separately visible.

In either embodiment, the bumper and bracket are configured so that the air tube is elevated above the lane a height approximately equal to one-half the diameter of a standard bowling ball 15. The outermost portions of the bumper/air tube are spaced a distance from the lateral edges of the lane so that when the ball is located along the outer edge of a lane, it just begins to make contact with the bumper.

Attached externally to each air tube is a pressure sensitive switch 50. When the bowling ball makes contact with the bumper assembly, the tube presses against and activates the pressure sensitive switch.

Figure 5:
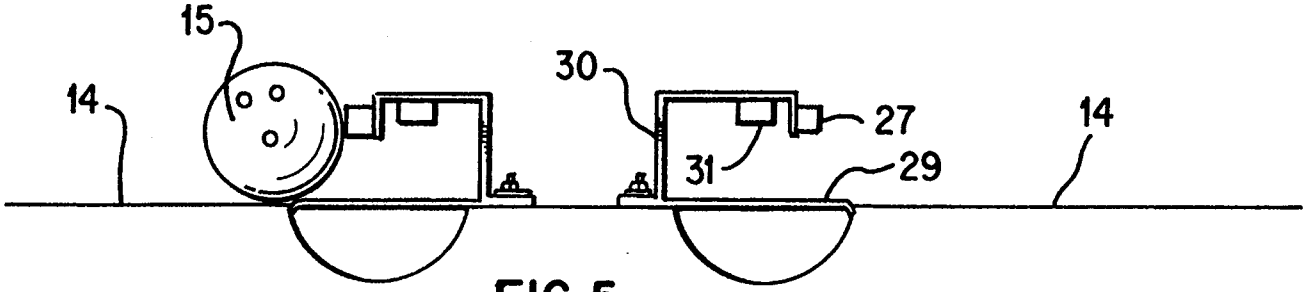
FIG. 5 illustrates in cross-section an alternative embodiment of the bumper system.

FIG. 5 illustrates an alternative embodiment, in which a pair of solid bumpers 11 is used instead of the air-tube arrangement of FIG. 4. A further feature of this embodiment is the use of brackets 30 that enable one to retrofit the bumper to an existing bowling lane. The switch is in the form of a motion sensor 31 attached to the underlying bracket, and is triggered when a bowling ball 15 makes contact with bumper. The switch may also take the form of a strip-like contact switch affixed to the bumper.

Figure 8:
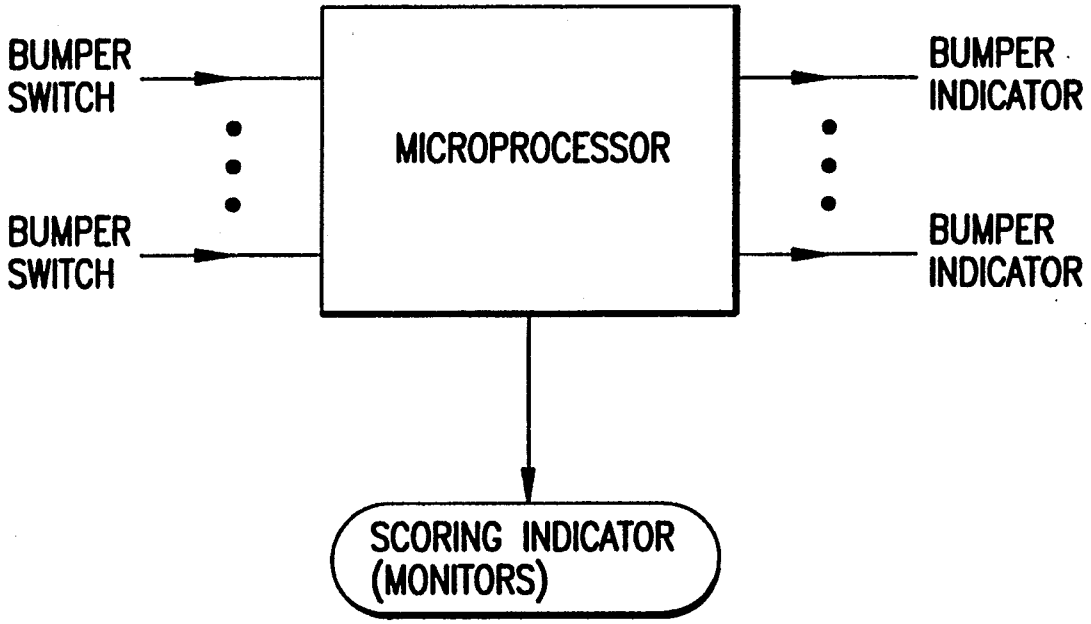
FIG. 8 shows in schematic form the control of the invention.

Whether a pneumatically triggered pressure sensitive switch, a motion sensor, or a strip-like contact switch is used, the closing of the switch or the triggering of the sensor provides information to a microprocessor or other simple switching device that can be used to signal that contact has been made with the bumper. For example, in FIG. 2, a pair of lights 70 and 72 is provided on each bumper. When the switch imbedded or affixed to a given bumper is triggered by contact with a bowling ball, an electrical circuit is completed that causes a light 72, a horn, or other indicator to be activated, thereby informing the player that contact with the bumper has been made. FIG. 8 shows the basic electrical pathway that this structure may employ. Instead of using a visually oriented indicator such as a light bulb, it is within the scope of this invention to employ an audible indicator, such as a bell or buzzer. The particular sound made by such an audible indicator could be made to vary in dependance upon the bumper with which it is associated. Such a system of indicators would enable the game to be enjoyed by those who are visually impaired.

The manner in which this information is used is dependant upon the game being played. For example, in one variant, contact with the bumper may simply indicate that one has rolled a "gutter ball," for which no points are earned. In essence, under this mode of use, one uses the system to play a standard game of bowling.

In another game, the object would be to hit one or more of the bumpers before any of the pins have been knocked down. No points would be given for knocking down a pin where the bumper has not first been struck. Alternatively, scoring could be the same as for regular bowling, except that it would not matter whether or not a ball has hit any of the bumpers.

A further mode of operation would count a ball that strikes a bumper as a gutter ball for one player, but not for another (e.g., a handicapped player). In this instance, the score-keeping machinery employed would keep track of the appropriate score for each player.

A further embodiment entails requiring the players to strike a bumper that has been designated by a microprocessor, where the designation may be indicated by the illumination of a first light 70 associated with a given bumper. The second light 72 may be configured to be illuminated if and when the appropriate bumper is struck, thereby awarding the player bonus points. Striking the illuminated bumper could be used to double or otherwise modify any resulting score. In FIG. 2, the number of bumper segments occupying a lane is three, however, it is within the scope of this invention to use more or fewer bumpers so as to better graduate the number of possible skill levels of the game.

Figure 7:
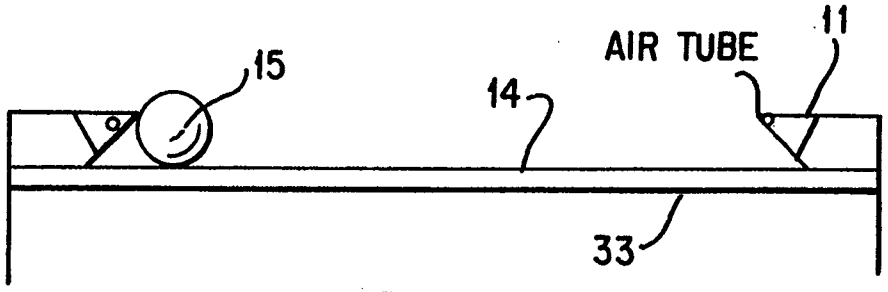
FIG. 7 shows in cross section a table-top game built according to the principles of the invention.

It is within the scope of this invention to apply these principles to a table-top bowling game as well (FIG. 7). The size of the table 33 relative to the length of a standard bowling lane may, of course, vary. However, by using a $\frac{1}{3}$ scale, one may utilize a common billiard ball as the bowling ball. In this embodiment, bumpers bearing contact switches would be mounted to the sides of the table. Again, contact with a given bumper would signal the system to enable the provision of a number of variants of the game as discussed above.

What is claimed is:

1. A bumper bowling system for a bowling lane, comprising:

a plurality of brackets;

a resilient bumper directly attached to each of said brackets;

means for detecting the impact of a bowling ball with the bumper; and means for indicating the impact of a bowling ball with the bumper, wherein the brackets are configured to have a fixed, stationary orientation at all times with respect to a bowling lane.

2. The device of claim 1, wherein the means for detecting the impact of a bowling ball with the bumper is a motion detector.

3. The device of claim 1, wherein the means for detecting the impact of a bowling ball with the bumper comprises a fluid-filled tube and a switch.

4. The device of claim 3, wherein the fluid-filled tube is molded into the bumper.

5. The device of claim 3, wherein the fluid-filled tube is in abutting relationship with the bumper.

6. The device of claim 3, wherein the fluid-filled tube is joined to the bumper with an adhesive.

7. The device of claim 6, wherein the area of the bumper to which the fluid-filled tube is attached is enclosed by a covering.

8. The device of claim 1, wherein the bracket is box-like in appearance, and has at least three right angles in cross-section.

9. The device of claim 1, wherein each bumper and bracket define an assembly, and there is attached to each assembly at least one indicating means.

10. The device of claim 9, wherein the indicating means provides a visual indication when activated.

11. The device of claim 9, wherein the indicating means provides an audible indication when activated.

12. The device of claim 9, wherein the indication provided by the indicating means varies from bumper to bumper.

13. The device of claim 1, further comprising a microprocessor that is connected to the detection means and to the indicating means.

14. The device of claim 1, wherein at least one bumper is arranged in a spaced apart facing relationship with at least one other bumper.

15. The device of claim 1, wherein the combined width of each of said bracket and its associated bumper means is less than or equal to 12 inches.

16. A bumper bowling system for a bowling lane, comprising:

a plurality of longitudinally extending brackets, said brackets being generally U-shaped in cross section, and further having dependant portions at the upper end of each side of the U that extend outwardly therefrom;

a resilient bumper directly attached to each side of each of said brackets;

means for detecting the impact of a bowling ball with the bumper; and means for indicating the impact of a bowling ball with the bumper, wherein the brackets are configured to have a fixed, stationary orientation at all times with respect to a bowling lane.

17. The device of claim 16, wherein the combined width of each of said bracket and its associated two bumpers is less than 24 inches.

18. A table-sized bumper bowling system, comprising:

a table having an upper surface for defining a bowling lane;

a plurality of brackets located along the sides of said table;

a resilient bumper attached to each of said brackets;

means for detecting the impact of a bowling ball with the bumper; and means for indicating the impact of a bowling ball with the bumper, wherein the brackets are configured to have a fixed, stationary orientation at all times with respect to a bowling lane.

19. The table-sized bumper bowling system of claim 18, where the table is approximately 20 feet in length.

* * * * *